US006327978B1

(12) United States Patent
Turano et al.

(10) Patent No.: US 6,327,978 B1
(45) Date of Patent: Dec. 11, 2001

(54) EXPLODING THIN FILM BRIDGE FRACTURING FRAGMENT DETONATOR

(75) Inventors: Andrew Turano, Wallingford; Dale L. Spencer, Killingworth, both of CT (US)

(73) Assignee: Kaman Aerospace Corporation, Bloomfield, CT (US)

( * ) Notice: Subject to any disclaimer, the term of this patent is extended or adjusted under 35 U.S.C. 154(b) by 709 days.

(21) Appl. No.: 08/848,094

(22) Filed: Jun. 27, 1997

Related U.S. Application Data

(63) Continuation-in-part of application No. 08/569,792, filed on Dec. 8, 1995, now abandoned.

(51) Int. Cl.[7] ..... F42B 3/10
(52) U.S. Cl. ..... 102/202.7; 102/202.5
(58) Field of Search ..... 102/202.5, 202.7, 102/202.8

(56) References Cited

U.S. PATENT DOCUMENTS

| | | | |
|---|---|---|---|
| 4,307,663 | 12/1981 | Stonestrom . | |
| 4,409,898 | 10/1983 | Blix et al. | 102/202.5 |
| 4,422,381 | 12/1983 | Barrett . | |
| 4,471,697 | 9/1984 | McCormick et al. . | |
| 4,502,096 | 2/1985 | Malone . | |
| 4,517,497 | 5/1985 | Malone . | |
| 4,538,088 | 8/1985 | Malone . | |
| 4,559,875 | 12/1985 | Marshall . | |
| 4,592,280 | 6/1986 | Shores . | |
| 4,602,565 | 7/1986 | MacDonald et al. . | |
| 4,632,034 | 12/1986 | Colle, Jr. . | |
| 4,651,646 | 3/1987 | Foresman et al. . | |
| 4,662,281 | 5/1987 | Wilhelm et al. . | |
| 4,716,832 | 1/1988 | Sumner . | |
| 4,762,067 | 8/1988 | Barker et al. . | |

(List continued on next page.)

OTHER PUBLICATIONS

Unclassified technical report by the Fuzes and Mines Branch of the Air Force Armament Laboratory Under Project 2502–08–15 from Jun. 1984 to Sep. 1985.

*Primary Examiner*—Harold J. Tudor
(74) *Attorney, Agent, or Firm*—Cantor Colburn LLP

(57) ABSTRACT

An exploding thin film bridge fracturing fragment detonator comprises a base layer with a bridge layer vapor deposited, e.g., sputtered, thereon. The bridge layer is comprised of an electrically conductive material and includes a bridge portion which interconnects significantly larger portions of this layer. An inorganic insulating layer of rigid fracturing material is vapor deposited, e.g. sputtered, on the bridge layer. A flyer layer is vapor deposited on the insulating layer, whereby the flyer layer is insulated electrically and/or thermally from the bridge layer. The flyer layer is sputtered directly over the bridge portion and is of a mass sufficient for at least a portion of the flyer layer and any associated insulating material that is fractured off therewith to be sufficiently propelled by an explosion of the bridge so as to cause the initiation by shock of a designated acceptor explosive (i.e., a secondary explosive). During use, a sufficient current is passed through the bridge portion to result in a rapid vaporization of the bridge portion. The expanding gas and magnetic field from this vaporization of the bridge portion causes a portion of the insulating layer and flyer layer to burst from the assembly as that portion of the insulating layer is fractured by the vaporizing bridge below and to accelerate rapidly away from the base at a velocity sufficient for detonation of the secondary explosive material which is located at a fixed distance from the flyer layer. Usually this separation distance is maintained by a layer overlaying the device with an opening over the flyer. This layer is commonly referred to as the barrel as it has some analogy to the barrel of a gun.

21 Claims, 3 Drawing Sheets

U.S. PATENT DOCUMENTS 4,852,493 8/1989 Boberg et al. .
4,862,803 9/1989 Nerheim et al. ..... 102/202.5
4,928,595 5/1990 Weingart .
4,938,137 7/1990 Guay ..... 102/202.7
4,944,225 7/1990 Barker .
4,976,200 12/1990 Benson et al. ..... 102/202.7
5,033,382 7/1991 Webb .
5,074,035 12/1991 Tyznik .
5,080,016 1/1992 Osher .
5,088,413 2/1992 Huber et al. .
5,229,542 7/1993 Bryan et al. .
5,245,926 9/1993 Hunter .
5,249,095 9/1993 Hunter .
5,249,526 10/1993 Cooksey .
5,269,223 12/1993 Mattsson et al. .
5,275,106 1/1994 Cutting et al. .
5,275,107 1/1994 Weber et al. .
5,291,828 3/1994 Nerheim et al. .
5,317,973 6/1994 Winaver et al. .
5,327,834 7/1994 Atkeson .
5,370,053 12/1994 Williams et al. .
5,370,054 12/1994 Reams et al. .
5,375,525 12/1994 Greenslade et al. .
5,431,104 7/1995 Barker ..... 102/312
5,454,321 10/1995 Biggs et al. .
5,479,860 1/1996 Ellis .
5,495,806 3/1996 Willey ..... 102/202.14
5,505,134 4/1996 Brooks et al. .

EXPLODING THIN FILM BRIDGE FRACTURING FRAGMENT DETONATOR

The present application is a continuation-in-part of U.S. patent application Ser. No. 08/569,792 entitled Exploding Foil Flying Disk filed Dec. 8,1995 abandoned.

BACKGROUND OF THE INVENTION

The present invention relates generally to the field of explosives and more particularly to means, known as detonators, used to detonate secondary explosives. More particularly, the present invention relates to an exploding thin film bridge fracturing flyer detonator for detonating secondary explosives.

It is well known that the passage of an electric current through a conductor generates a certain amount of heat, the amount of heat varying directly with the resistance of the conductor and with the square of the current. This phenomenon is relied upon in fusible links that are installed in electrical circuits to prevent the flow of more than a predetermined amount of current in such a circuit. When the predetermined flow is exceeded, the heat melts the fusible link so that the circuit is broken. If a sufficient current is passed through the link in a small period of time, the link is not only melted but may be vaporized. If the fusible link is enclosed in a small space the vaporizing of the link can increase the pressure in that space.

The blasting caps include a heat sensitive primary explosive set off by an electrical resistance heated by the passage of an electric current through the resistance. The exploding bridge wire devices detonate a primary explosive using a relatively low resistance bridge extending between conductors and through which a relatively high current is passed so that the bridge portion is not only heated to its melting point but is heated so much that it vaporizes and literally explodes to provide a shock wave to detonate the primary explosive. While such a system can use a primary explosive that is much less sensitive to heat and shock than a secondary explosive, there are still a distressing number of accidents that occur when the primary explosive is prematurely detonated, such a system does not provide the kinetic energy necessary to achieve reliable initiation of secondary explosives. Accordingly, a need exists for a more reliable and safe means for initiating secondary explosives.

Traditional exploding foil initiators, otherwise known as slappers, function by passing sufficient current through a metal foil or other conductor as to cause that material to vaporize. The pressure of this vaporization in concert with other vaporization phenomena cause a plate or disk to be driven to an acceptor explosive (i.e., a secondary explosive). The physical impact of this flying plate is such as to cause the explosive to be shock initiated. These devices have typically been constructed using materials for the flying plates which are organic or insulating layer which are organic. These organic materials have been limited to those that yield plastically before fracturing. This causes the effective surface area of the flying plate to be reduced by the amount of plastic deformation, otherwise known as the bubble effect.

Recently, it has been proposed to detonate these more stable explosives by an electrical means of some sort that creates a sudden pressure to shear a film and form a disk or flyer which is then impacted against the explosive material One such example is disclosed in U.S. Pat. No. 4,602,565 (which is incorporated herein by reference) wherein an exploding foil detonator uses an explosive that is detonated by a flyer that is sheared form a sheet or film and propelled through a barrel to impact the explosive. The flyer is sheared from the sheet by the pressure generated when an electrical conductor adjacent the sheet is vaporized by the sudden passage of a high current (as by the discharge of a capacitor) through it. While this and other patents talk of the flyer being sheared this shearing does not occur until the material has experienced plastic deformation for the organic materials used to date, i.e. parylene and polymide. This plastic deformation, i.e., bubble effect, that occurs prior to shearing has the undesirable affect of reducing the effective surface are of the flyer. This reduction in flyer impact area reduces the kinetic energy transfer. This effectively reduces the likelihood that the impact will detonate a given explosive.

Organic compounds, e.g. parylene and polyamide, which have been used to date for the flyer and/or the insulating layer of prior art have susceptibility to the promotion of fungus growth and present considerable complexity to material compatibility, especially explosive compatibility analysis, due to both the complexity of their make up and the complexity of the chemical process and resulting chemical residue from their deposition.

As is typical in the prior art, the capacitor is in a circuit with the exploding thin film fracturing fragment detonator and a normally open switch. When it is desired to arm the system, the capacitor is charged, e.g., to 1000 volts; when it is desired to initiate the explosion, the switch is closed and the capacitor discharges through the thin film vaporizing the same.

SUMMARY OF THE INVENTION

The above-discussed and other problems and deficiencies of prior art are overcome or alleviated by the exploding thin film fracturing fragment detonator of the present invention. In accordance with the present invention, the exploding thin film bridge fracturing fragment detonator comprises a base with a bridge layer physically vapor deposited, e.g., sputtered, thereon. The bridge layer comprises a metal film or other thin film current conducting material having a defined bridge portion which interconnects significantly larger portions of this layer. The use of thin film sputtering allows the composition of the bridge layer to have superior homogeneity and superior uniformity of grain structure. These are significant in the determination of the statistical variance of the energy required to burst and in the thinness of a useful film deposition that can be achieved. This is an important feature of the present invention when low (e.g., less than 100 mili-joule) energy applications or energy input to output efficiencies are considered. A high variance in these parameters results in a high variance in the all fire to no fire ratios of the device itself (an undesirable effect from a safety viewpoint). The thinness of the bridge layer is a major determinate of the energy to burst level. An inorganic insulating layer of rigid material is physically vapor deposited, e.g. sputtered, on the metal layer. The rigidity of the insulator material is sufficiently high so as to promote fracture rather than plastic yielding and thus significantly reduce the adverse bubble effect common in prior art using more plastic materials. Further, this action promotes a smooth separation of a flyer (defined below) from the device under the pressure of the vaporization of the thin film bridge layer. A flyer comprised of a material having a density at least equal to that of the insulating material is vapor deposited on the insulating layer (e.g., of dielectric material). The insulating layer is comprised of a material which is materially compatible and stable with the material of the bridge layer, for electrically and/or thermally insulating between the bridge and flyer layers during the vaporization, at least until the flyer has separated and is in flight to the acceptor explosive. The flyer layer is positioned directly over the bridge portion and is of a tensile strength sufficient to remain intact while the insulating layer fractures freeing the flyer layer (or a portion thereof) for acceleration to the acceptor explosive as a single fragment of sufficient size (mass) that when sufficiently propelled causes on impact with the acceptor explosive the detonation of that explosive as a result of the shock impact.

During use a sufficient voltage is applied across the bridge whereby the resulting current passes through the bridge resulting in a vaporization of the bridge. The flow of this current is facilitated by the low resistance to the flow that the homogeneous uniform grained thin film metal provides. The expanding gas from the vaporization of the bridge portion causes the flyer layer together with a portion of the insulating material to accelerate rapidly away from the base layer at a velocity sufficient for detonation of a secondary explosive material spaced at a sufficient distance from the device for this flyer material to have accelerated to the threshold detonating velocity. The flyer is preferably comprised of a magnetic material whereby it may be boosted in velocity by the so-called "rail-gun" effect caused by the magnetic coupling of the flyer metal and the expanding electromagnetic field of the vaporization.

The exploding thin film bridge fracturing fragment detonator of the present invention provides intimate controlled contact between the layers and the precision at which the material is dimensioned and positioned relative to each other greatly increases the reliability of the present detonation device as compared to the flying plate detonators of the prior art. The use of all inorganic materials greatly simplifies the material compatibility over prior art and provides for a longer useful life; thereby, avoiding the deficiencies of the prior art organic materials. More specifically, the inorganic materials are more reliable they do not promote fungus growth within the device. Also the material compatibility is highly predictable over time and in various environments as the deposition process does not require other chemicals or compounds, e.g. wetting agents, hardeners, etc., and is completely inorganic. Further the melting temperature is much higher than that of the organic compounds used in prior art, making this device better suited for high temperature applications. The choice of materials for the bridge and insulator and flyer layers provide for a more energy efficient design. This increase in efficiency over the prior art flying plate and conventional exploding foil detonators reduces size and cost associated with the initiating energy device.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
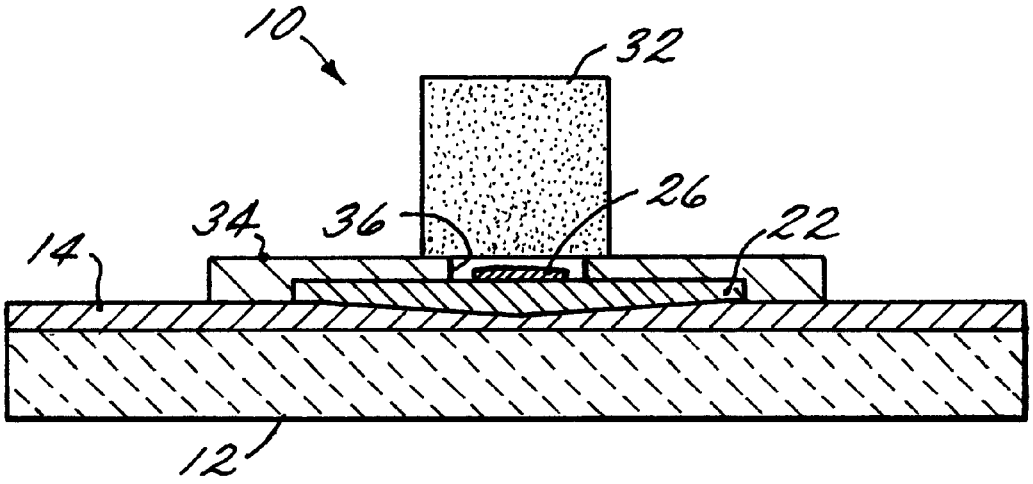
FIG. 1 is a partial, diagrammatic, cross sectional, side elevation view of a detonating device in accordance with the present invention.
Figure 2:
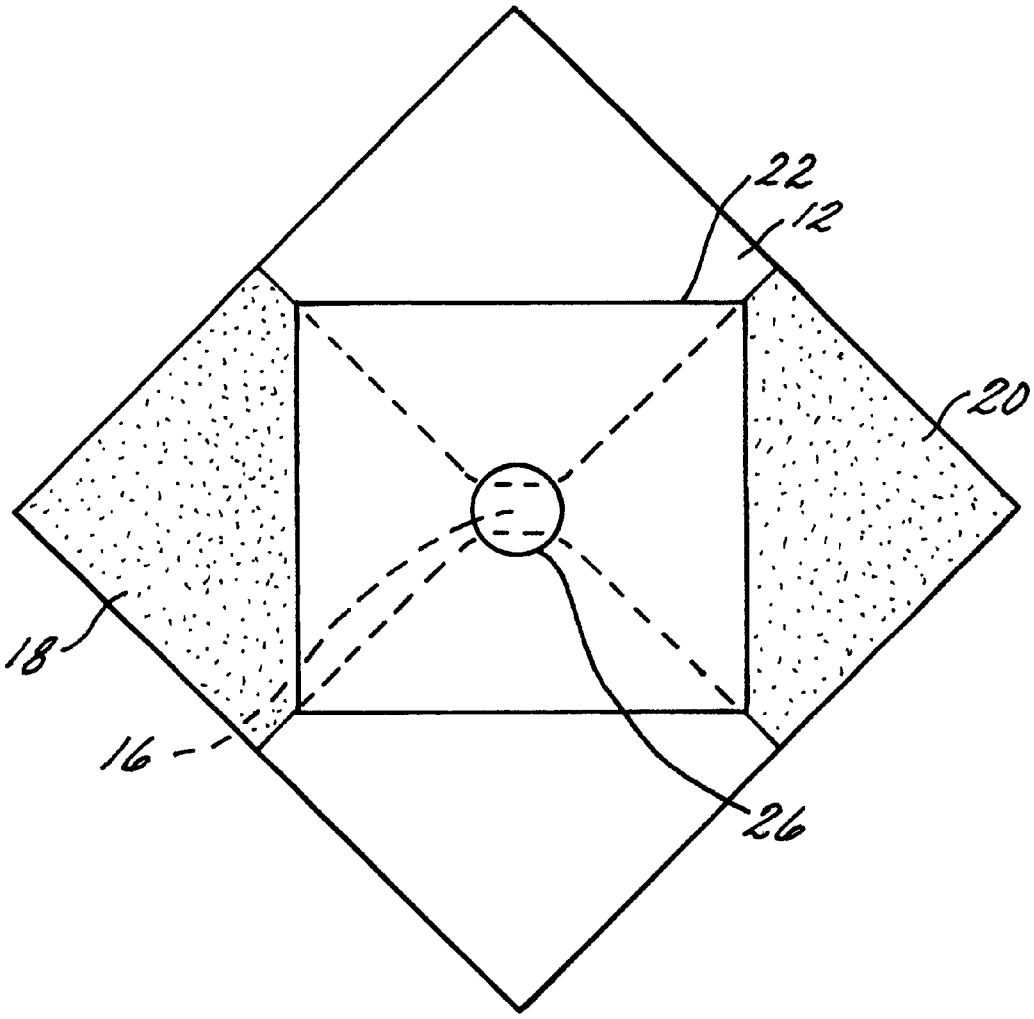
FIG. 2 is top plan view of a partially formed detonating device of FIG. 1.
Figure 3:
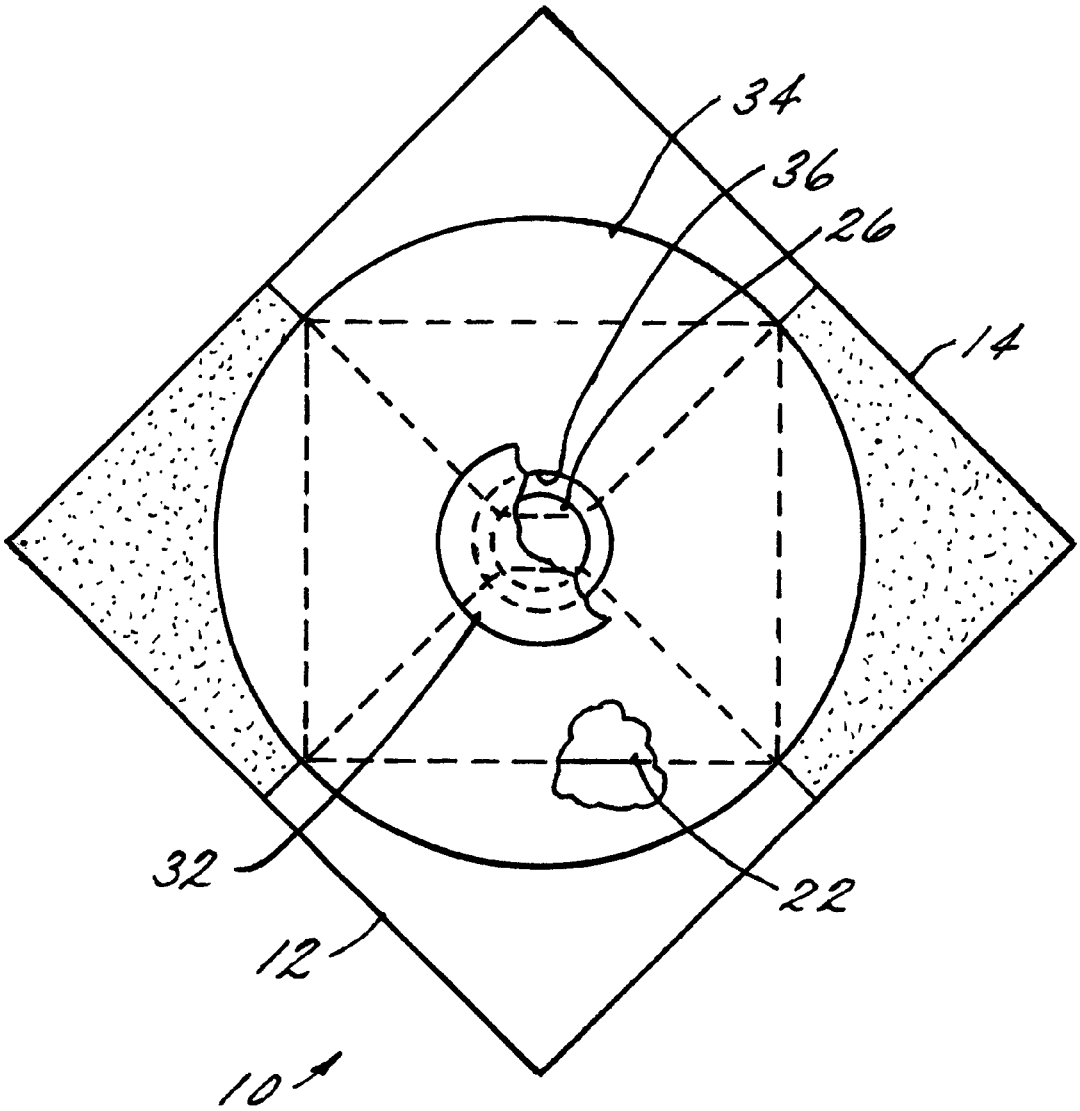
FIG. 3 is top plan view of the detonating device of FIG. 1.

Referring to FIGS. 1–3, an exploding thin film bridge fracturing fragment detonator 10 comprises a base 12 with a metal thin film or other conducting material layer (i.e., bridge layer) 14 vapor deposited thereon, The thin film metal or other conducting material layer 14 includes a bridge portion 16 which interconnects significantly larger portions 18, 20 of layer 14. Base 12 is comprised of a hard, smooth surface material that will accept physical vapor deposition of materials with sufficient adhesion, e.g., KAPTON (a trademark of Dupont for a polyimide film), glass, alumina, corundum, quartz, silicon, sapphire or any other high resistance material for which the surface thereof may be made sufficiently smooth so as to support the deposition of the thin film bridge layer. It may be preferred, although not shown, to deposit a thin layer of Chromium (Cr) or other material on base layer 12 prior to depositing layer 14 to promote adhesion (by nucleation) of the thin film (layer 14) to the base material, this will depend especially on the base material selected. The metal thin film or other conducting material layer 14 is sputtered on base 12 through a mask detailing the features of layer 14 (i.e., bridge portion 16) as is known in the vapor deposition art. The deposition of metal is continued until a desired thickness is achieved, then the mask is removed leaving layer 14.

A layer 22 of dielectric material is vapor deposited, e.g. sputtered, on a sufficient portion of layer 14 (including bridge portion 16) to provide for the necessary electrical and/or thermal insulation between layers 14 and 26 using a mask defining the area of layer 22, as is known in the vapor deposition art. Layer 22 is of a size and shape for completely covering bridge portion 16. Another mask is employed for vapor deposition, e.g. sputtered, of a metal layer 26 (i.e., a metal flyer) on layer 22, registered such that the resultant layer is generally centered over bridge portion 16. Layer 22 is preferably comprised of dielectric material (e.g., a metallic oxide such as aluminum oxide) for electrical and thermally insulating between layers 14 and 26. Layer 14 is comprised of an electrically conductive metal, e.g., copper or aluminum. Layer 26 is preferably comprised of an electrically conductive and potentially magnetic metal, such as, amalgam of cobalt, nickel and chromium. Layer 26 may be comprised of any of these metals individually or in combination as well as titanium or other metals provided they have sufficient strength to allow a flyer to survive the shock and stresses of the bridge vaporization and the rapid acceleration to the acceptor explosive. Metal flyer 26 is position directly over bridge portion 16 and is of a mass such that it is sufficiently propelled by the explosion of bridge portion 16, as described hereinbelow. Further, metal flyer 26 is shaped so as to overlay bridge portion 16 completely in the x, y and z directions, so as to insure that the vaporizing energy will be well transferred into kinetic energy of motion of the flyer in a direction orthogonally away from a plane of the base and bridge layers.

In a preferred embodiment, electrical connection to layer 14 is made at portions or layer 14 that are not covered by layer 22 by known surface connection techniques such as wire bonding with the metal of layer 14 (or an oxidized layer thereof). In another embodiment, base 12 includes openings therethrough each one aligned with a corresponding portion 18, 20 of layer 14. These openings are filed with metal, preferably at the same time or prior to the vapor deposition of layer 14, whereby the resulting vias are integral with layer 14. Alternatively, the above described vias could be replaced with conductive post.

During use a sufficient electrical force is applied across the electrical connection, such that the resulting current passes through bridge portion 16 resulting in a vaporization of bridge portion 16. The expanding gas from the vaporization of bridge portion 16 causes metal flyer 26 to accelerate rapidly away from base 12 (i.e., a flying disk) at a velocity sufficient for detonation of a secondary explosive material 32 spaced at a fixed distance from disk 26. A spacer 34 having an opening 36 for the flyer is employed to maintain the desire distance between disk 26 and the secondary explosive material 32, as is known in the art. The impact of metal disk 26 on the secondary explosive material 32 propagates a shock wave the pressure time characteristics of which therethrough causing detonation thereof. The secondary explosive material 32 is preferably a HNS explosive pellet and more preferably a HNS-IV explosive pellet. The robustness in terms of the pressure time output of these devices is thought to be such that they will be able to made such that the initiation of less sensitive formulations of HNS than HNS-IV will be able to be reliably detonated.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A detonator device for detonating an explosive pellet, comprising:

an electrically non-conductive base;

a first layer of electrically conductive material deposited on said base, said first layer including a bridge portion interconnecting two larger portions thereof;

a second layer of an inorganic material deposited on said first layer, over at least said bridge portion of said first layer; and a third layer of metal deposited on said second layer directly over said bridge portion, said third layer being electrically isolated from said first layer by said second layer, said third layer itself or when combined with a portion of said second layer comprises a mass such that when said mass is propelled by vaporization of said bridge portion said mass is sufficient for detonation of the explosive pellet spaced at a fixed distance from said third layer.

2. The device of claim 1 wherein:

said first layer is vapor deposited on said base;

said second layer is vapor deposited on said first layer; and said third is vapor deposited and said second layer.

3. The device of claim 1 further comprising:

an electrical connection at said first layer across said bridge portion.

4. The device of claim 3 wherein said means for electrical connection comprises:

a surface attachment to larger portions of said first layer, at least part of said larger portions extending beyond said second layer deposited thereon, thereby providing said surface attachment.

5. The device of claim 1 wherein said base comprises KAPTON, glass, alumina, quartz, corundum, silicon or sapphire.

6. The device of claim 1 wherein said first layer comprises copper or aluminum.

7. The device of claim 1 wherein said third layer comprises a magnetic material.

8. The device of claim 7 wherein said magnetic material comprises an amalgam of cobalt, nickel and chromium.

9. The device of claim 1 wherein said second layer comprises of an inorganic dielectic material of sufficient rigidity, whereby said inorganic dielectric material will fracture before yielding plastically.

10. The device of claim 9 wherein said inorganic dielectric material comprises a metallic oxide.

11. The device of claim 10 wherein said metallic oxide is an aluminum oxide.

12. A method of forming a detonating device, comprising the steps of:

depositing a first layer of electrically conductive material on an electrically non-conductive base, said first layer including a bridge portion interconnecting two larger portions;

depositing a second layer of inorganic material on said first layer, over at least said bridge portion of said first layer; and depositing a third layer of material on said second layer directly over said bridge portion, said third layer being electrically isolated from said first layer by said second layer, said third layer itself or when combined with a portion of said second layer comprises a mass such that when said mass is propelled by vaporization of said bridge portion said mass is sufficient for detonation of the explosive pellet spaced at a fixed distance from said third layer.

13. The method of claim 12 wherein said steps of depositing each comprise vapor depositing.

14. The method of claim 12 wherein at least part of said larger portions extends beyond said second layer deposited thereon, thereby providing a surface attachment.

15. The method of claim 12 wherein said base comprises KAPTON, glass, alumina, quartz, corundum, silicon or sapphire.

16. The method of claim 12 wherein said first layer comprises copper or aluminum.

17. The method of claim 12 wherein said third layer comprises a magnetic material.

18. The method of claim 17 wherein said magnetic material comprises an amalgam of cobalt, nickel and chromium.

19. The method of claim 12 wherein said second layer comprises of an inorganic dielectic material of sufficient rigidity, whereby said inorganic dielectric material will fracture before yielding plastically.

20. The method of claim 19 wherein said inorganic dielectric material comprises a metallic oxide.

21. The method of claim 20 wherein said metallic oxide is an aluminum oxide.

* * * * *